US010479662B2

(12) United States Patent
Hamlik et al.

(10) Patent No.: US 10,479,662 B2
(45) Date of Patent: Nov. 19, 2019

(54) FORK POSITIONER WITH GUIDED FORK HOLDER

(71) Applicant: Rightline Equipment, Inc., Rainer, WA (US)

(72) Inventors: Jim D. Hamlik, Vancouver, WA (US); Joel D. Hamlik, Vancouver, WA (US)

(73) Assignee: Rightline Equipment, Inc., Rainer, OR (US)

( * ) Notice: Subject to any disclaimer, the term of this patent is extended or adjusted under 35 U.S.C. 154(b) by 0 days.

(21) Appl. No.: 15/736,272

(22) PCT Filed: Jun. 15, 2016

(86) PCT No.: PCT/US2016/037640
§ 371 (c)(1),
(2) Date: Dec. 13, 2017

(87) PCT Pub. No.: WO2016/205376
PCT Pub. Date: Dec. 22, 2016

(65) Prior Publication Data

US 2018/0155168 A1 Jun. 7, 2018

Related U.S. Application Data

(60) Provisional application No. 62/180,588, filed on Jun. 16, 2015.

(51) Int. Cl.
*B66F 9/14* (2006.01)

(52) U.S. Cl.
CPC ..... *B66F 9/143* (2013.01)

(58) Field of Classification Search
CPC ..... B66F 9/142; B66F 9/143; B66F 9/144; B66F 9/146
See application file for complete search history.

(56) References Cited

U.S. PATENT DOCUMENTS 4,960,357 A * 10/1990 Laursen ..... B66F 9/142 414/667
5,033,934 A * 7/1991 Emilio ..... B66F 9/142 414/667

(Continued)

FOREIGN PATENT DOCUMENTS

DE 112016002754 T5 * 4/2018 ..... B66F 9/143
EP 2588401 B1 * 7/2016 ..... B66F 9/12

(Continued)

*Primary Examiner* — Kaitlin S Joerger
(74) *Attorney, Agent, or Firm* — Rylander & Associates PC; Philip R. M. Hunt

(57) ABSTRACT

A fork positioning assembly configured for mounting to a lift truck, comprising a first fork positioner and a second fork positioner coupled to a fork frame. The first fork positioner a substantially mirror image of the second fork positioner. Each fork positioner comprises a tube with an interior cavity within which is positioned a piston and a carrier both coupled to a rod. The piston and carrier are both in sliding contact with the tube. Each fork positioner has a fork holder positioned external to the tube, the fork holder coupled to the carrier through the slot in the tube. The portion of the carrier coupled to the fork holder is between a first carrier bushing and a second carrier bushing.

17 Claims, 5 Drawing Sheets

(56) References Cited

U.S. PATENT DOCUMENTS

| | | | | | |
|---|---|---|---|---|---|
| 5,807,060 | A * | 9/1998 | Hamlik | ..... | B66F 9/148<br>414/668 |
| 7,632,055 | B2 * | 12/2009 | Foroni | ..... | B66F 9/148<br>384/26 |
| 10,040,675 | B2 * | 8/2018 | Kuck | ..... | B66F 9/075 |
| 2013/0177374 | A1 * | 7/2013 | Matti | ..... | B66F 9/12<br>414/667 |

FOREIGN PATENT DOCUMENTS

| | | | | | |
|---|---|---|---|---|---|
| WO | WO-2012093120 | A1 * | 7/2012 | ..... | B66F 9/143 |
| WO | WO-2014122147 | A1 * | 8/2014 | ..... | B66F 9/142 |

* cited by examiner

FORK POSITIONER WITH GUIDED FORK HOLDER

CROSS-REFERENCE TO RELATED APPLICATIONS

This application claims the benefit of U.S. Provisional Application No. 62/180,588, filed 2015 Jun. 16, incorporated herein by reference.

FIELD OF THE INVENTION

The present invention relates to cargo handling equipment. More particularly, the present invention relates to fork positioners for use primarily with lift trucks.

BACKGROUND

Material handling vehicles such as lift trucks are used to pick up and deliver loads between stations. A typical lift truck 10 has a mast 12, which supports a load-lifting carriage 14 that can be raised along the mast 12 (see FIG. 1). The carriage 14 typically has one or more carriage bars 16 to which a fork frame 18 is mounted. The carriage bars 16 are coupled to the mast in a way that allows the lift truck 10 to move the carriage bars 16 up and down, but not laterally relative to the truck. The fork frame 18 carries a pair of forks 20. A driver of the lift truck 10 maneuvers the forks 20 beneath a load prior to lifting it. In the course of moving various loads, the drivers may need to change the lateral position of the forks 20 relative to each other. To change the lateral position of the forks 20 on the lift truck 10 shown in FIG. 1, the driver must dismount from the lift truck 10 and manually reposition the forks 20.

A powered fork positioner allows the driver of a lift truck so equipped to change the lateral position of the forks without dismounting from the lift truck. This can save effort, time and money. A typical fork positioner uses hydraulic actuators mounted to the fork frame to move the forks relative to the fork frame.

A fork positioner may be combined with a side shifter. A typical side shifter uses hydraulics for laterally displacing the fork frame with respect to the center line of the lift truck. A hydraulic actuator connecting the truck carriage to the fork frame provides the shifting action. A side shifter is useful in situations where the driver has the correct distance between the forks set, but needs to have a precise alignment between the forks and the pockets in the load that are available to receive the forks. Pallets carrying loads have very wide pockets in the pallet for receiving forks. For working with pallets, precise alignment of the forks with the load is not necessary. Other loads may only have pockets that are not much wider than the forks, requiring precise alignment. A driver may not be able to reliably align the forks with the pockets using the whole lift truck, necessitating backing up the entire lift truck and trying again until alignment is achieved. A side shifter allows the driver to make small adjustments in aligning the forks with the load if an approach with the entire lift truck fails to align the forks with the load adequately.

Fork positioners and side shifters are well known, but existing designs connect the forks to hydraulic actuators with an exposed actuator rod. The exposed actuator rod is vulnerable to damage from contact with loads and other objects in their normal work environment. The actuator rod needs to have a smooth finish to pass through the seals in the hydraulic actuator. Even small nicks in the surface of the actuator rod can damage the seals when the actuator rod is withdrawn into the actuator. This can necessitate more frequent replacement of seals, leading to higher maintenance costs and more down time for the lift truck.

Additionally, the exposed actuator rod not only transmits the force for moving a fork from the actuator to the fork, but also any moment generated by the application of the force to the fork. Moment is generated in the actuator rod because the force applied to a fork usually causes a deflection in the fork (unless the fork is secured so that it cannot rotate even the slightest degree and is perfectly rigid or secured at fulcrums equidistant from the center of where the force is applied—conditions that can almost never be arranged in a practical forklift). The force is not applied to the fork at a single point, but over a finite area. Even if the force is evenly distributed over that area, when a portion of that area is deflected more than other portions of that area, the distribution of the force over the area becomes uneven, causing a moment to be transmitted back into the object applying the force—i.e., the actuator rod. This moment causes a deflection in the actuator rod, which if severe enough, can cause a permanent distortion in the actuator rod. An actuator rod with a distortion can damage the seals of the actuator when the rod is drawn in and may even jam in the actuator. The amount of deflection caused by a given amount of moment is increased as the length of the actuator rod is increased. Designers of fork positioners have had to take these considerations into account and usually have responded by making the actuator rod thicker than would be necessary to transmit the required force just to make the rod more resistant to deflection caused by moment. This necessitates a larger polished surface for passing through the seals of the actuator and larger seals as well.

BRIEF DESCRIPTION OF THE DRAWINGS

The present invention will be described by way of representative embodiments, illustrated in the accompanying drawings in which like references denote similar elements, and in which.

DETAILED DESCRIPTION

Before beginning a detailed description of representative embodiments of the subject invention, mention of the following is in order. When appropriate, like reference materials and characters are used to designate identical, corresponding, or similar components in different figures. The figures associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application and business related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Use of directional terms such as "upper," "lower," "above," "below", "in front of," "behind," etc. are intended to describe the positions and/or orientations of various components of embodiments of the invention relative to one another as shown in the various Figures and are not intended to impose limitations on any position and/or orientation of any embodiment of the invention relative to any reference point external to the reference. Herein, "left" and "right" are from the perspective of a driver of a lift truck when the driver is facing the fork frame. Herein, "lateral" refers to directions to the left or the right and "longitudinal" refers to a direction perpendicular to the lateral direction and to a plane defined by the fork frame.

Figure 1:
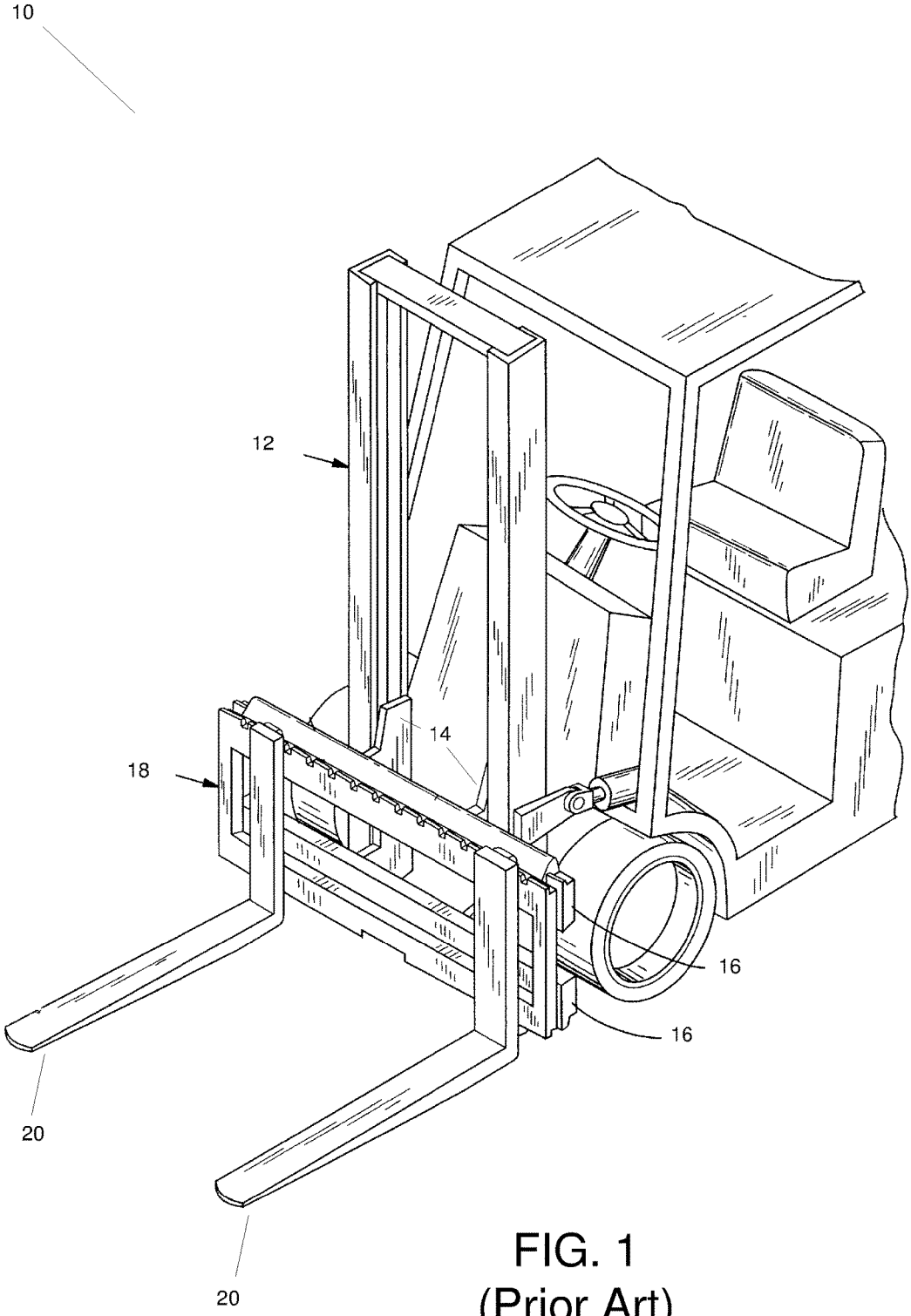
FIG. 1 (Prior Art)
FIG. 1 is an isometric view of a prior art lift truck, illustrating typical components of a lift truck.
Figure 2:
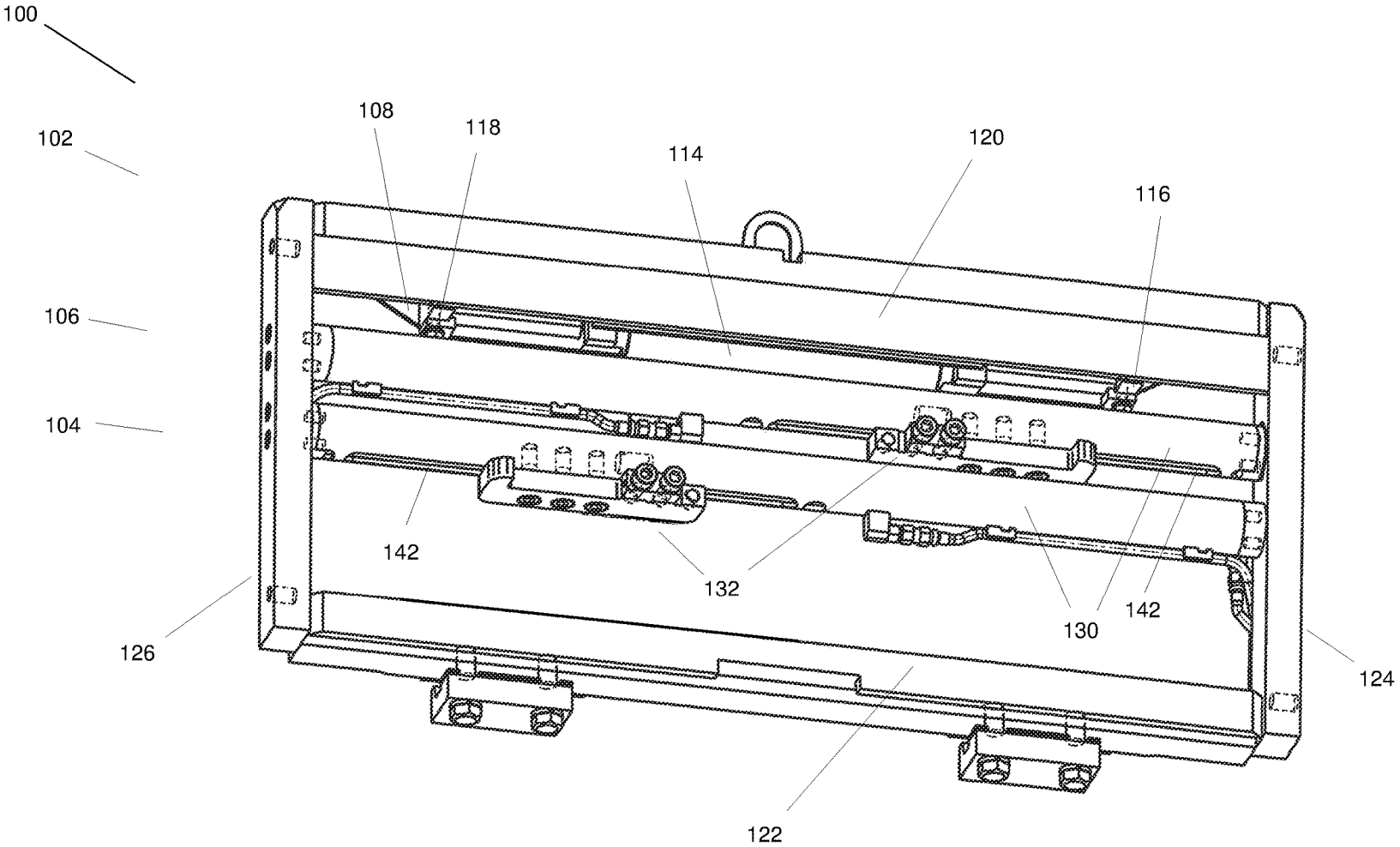
FIG. 2 is a front isometric view of a representative embodiment of an inventive fork positioner assembly.
Figure 3:
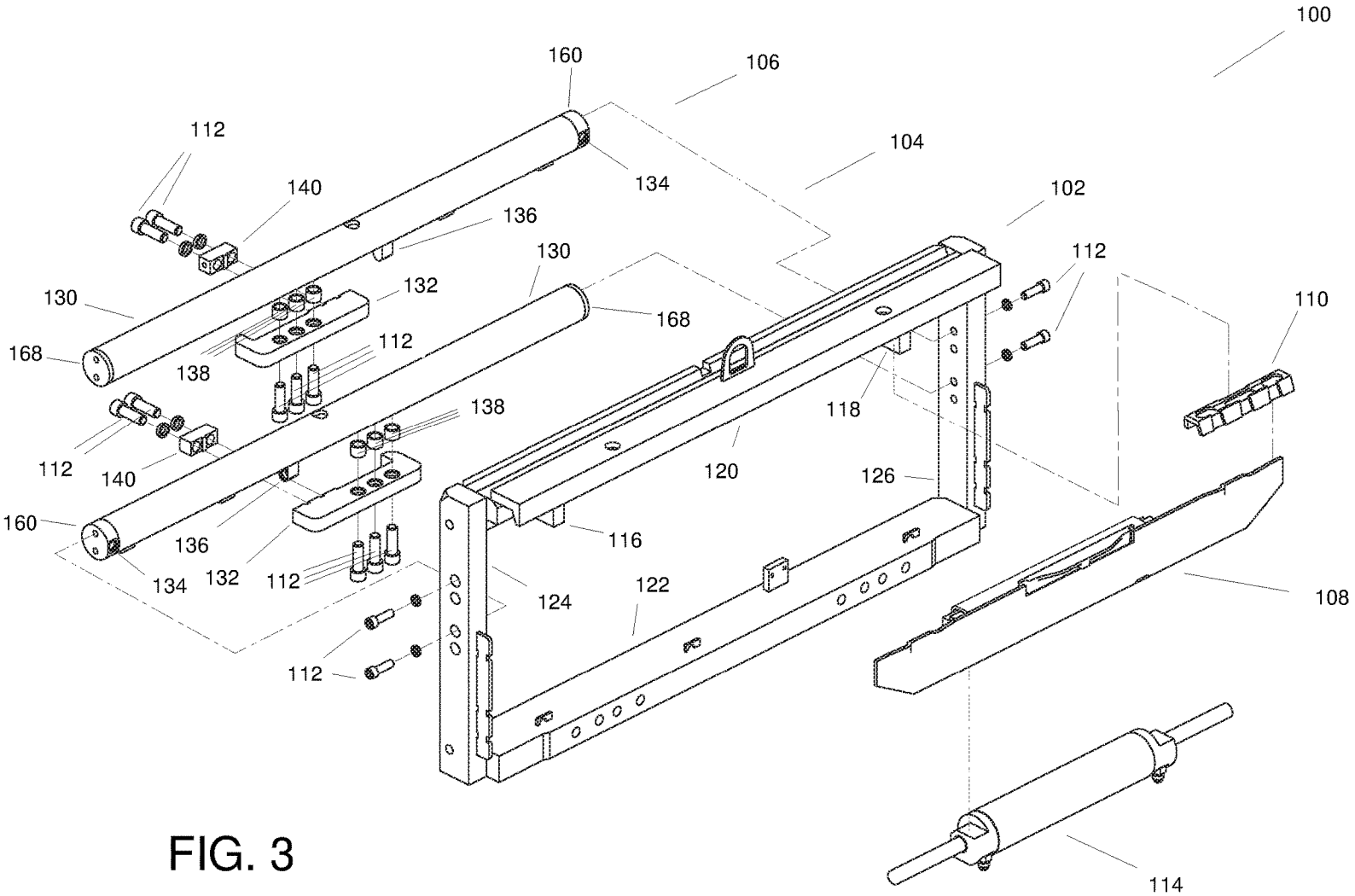
FIG. 3 is an exploded isometric rear view of the representative embodiment of the fork positioner assembly.

FIGS. 2-3 illustrate a representative embodiment of a fork positioner assembly 100. The fork positioner assembly 100 comprises a fork frame 102, a first fork positioner 104 and a second fork positioner 106. Each fork positioner controls the lateral position of one fork (not shown in FIGS. 2-3). The fork positioner assembly 100 shown in the embodiment of FIGS. 2-3 has two fork positioners to control two forks, but in other embodiments, additional fork positioners may be added to control additional forks. The fork frame 102 is configured to allow the forks to be slidingly coupled to the fork frame 102 in a way that allows the forks to move laterally. Typically, the fork frame 102 has a bar of some sort extending laterally to which the forks are attached and with bearing material interposed between the bar and the forks.

The fork frame 102 comprises a fork frame top bar 120, a fork frame bottom bar 122, a fork frame left side bar 124, and a fork frame right side bar 126. The fork frame 102 has a registration bar 108 that is coupled to the fork frame top bar 120 and configured to be fixed to the carriage 14 of a lift truck 10. In the representative embodiment, the registration bar 108 has a side shifter 114 fixed thereto. The registration bar 108 is slidingly coupled to the fork frame top bar 120 through one or more fork frame bearings 110. The side shifter 114 engages left tab 116 and right tab 118, both fixed to the fork frame top bar 120. The side shifter 114 when actuated will push either against the left tab 116 or the right tab 118, depending on which side of the side shifter 114 is actuated, in this case, by hydraulic fluid under pressure ported to it. Actuating the side shifter 114 thus results in the fork frame 102 moving laterally, either right or left, depending on which side of the side shifter 114 is actuated. The side shifter 114 is positioned underneath the fork frame top bar 120 and above the fork positioners 104, 106. Other embodiments, the side shifter 114 is omitted from the fork positioner assembly 100, in which case, the registration bar 108 is fixedly coupled to the fork frame top bar 120.

The first fork positioner 104 is coupled to the fork frame 102 between the fork frame left side bar 124 and fork frame right side bar 126. The second fork positioner 106 is similarly coupled to the fork frame 102 between the fork frame left side bar 124 and fork frame right side bar 126 either above or below the first fork positioner 104. As shown in FIGS. 2-3, the first fork positioner 104 is positioned below the second fork positioner 106, but in other embodiments, the first fork positioner 104 may be positioned above the second fork positioner 106. In the representative embodiment, the fork positioners 104, 106, are coupled to the fork frame 102 with cap screws 112, but in other embodiments may be coupled by welding or other suitable method.

The first fork positioner 104 and second fork positioner 106 are substantially identical in the representative embodiment, using substantially identical components. The first fork positioner 104 is a mirror image of the second fork positioner 106 relative to a vertical plane intersecting and perpendicular to the fork frame top bar 120 and the fork frame bottom bar 122. Using substantially identical components for both fork positioners 104, 106 simplifies parts inventories for the manufacturer and for the end user. In other embodiments, the first fork positioner 104 and second fork positioner 106 may be substantially different from each other and use substantially different components.

As shown in FIGS. 2-3, the first fork positioner 104 is configured to operate a fork to the right side of the fork frame 102 and the second fork positioner 106 is configured to operate a fork to the left side of the fork frame 102, but in other embodiments, the first fork positioner 104 may be configured to operate a fork to the left side of the fork frame 102 and the second fork positioner 106 is configured to operate a fork to the right side of the fork frame 102.

The first fork positioner 104 will now be described in more detail. It is understood that in the representative embodiment, the second fork positioner 106 has identical parts that function in identical ways. The first fork positioner 104 comprises an actuator tube 130, and a fork holder 132. The fork holder 132 is coupled to internal components of the first fork positioner 104 through a slot 142 in the actuator tube 130. In the representative embodiment, the tube slot 142 is located on the underside of the actuator tube 130, to minimize accumulation of foreign material inside the actuator tube 130, but in other embodiments, the tube slot 142 may be located on the top side of the actuator tube 130. The fork holder 132 is a component configured to hold a fork in position and to apply lateral force to the fork to move it laterally to a different position. In the representative embodiment, the fork holder 132 comprises a plate with a protrusion at each end, forming a pocket that restrains a fork laterally and to the rear, but not vertically or forward. However, in other embodiments, the fork holder 132 may be configured to be fixedly coupled to a fork, restraining movement of the fork in all directions. In the representative embodiment, one of the protrusions on the fork holder 132 is a fork retainer 140 which is configured to be removeably coupled to the rest of the fork holder 132. The fork retainer 140 can be removeably coupled to the rest of the fork holder 132 in more than one position, allowing for different sized pockets to be created in the fork holder 132 to accommodate different sized forks.

Figure 4:
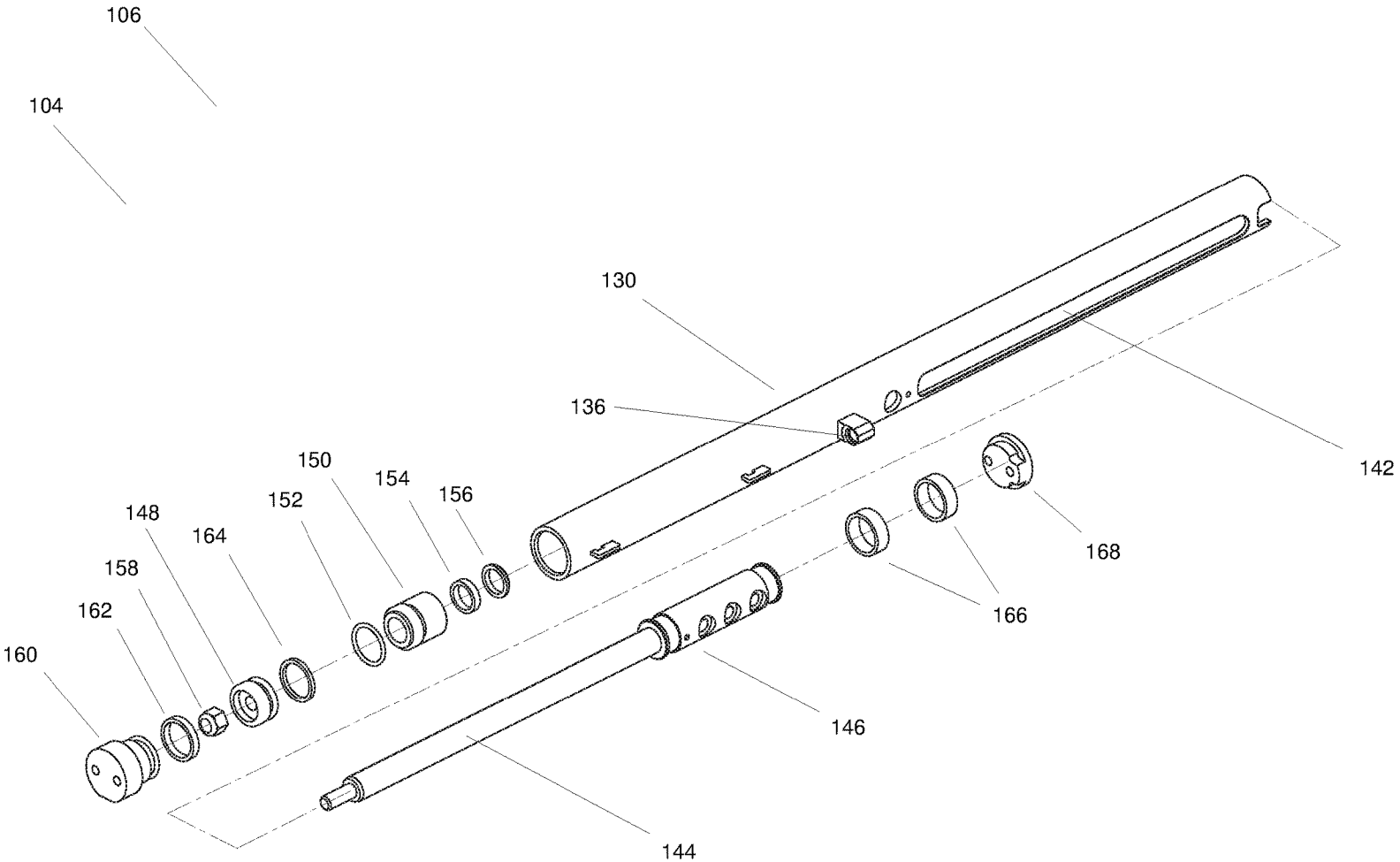
FIG. 4 is an exploded isometric bottom view of an inventive fork positioner from the representative embodiment of the fork positioner assembly shown in FIGS. 2-3, with fork holders omitted for clarity.
Figure 5:
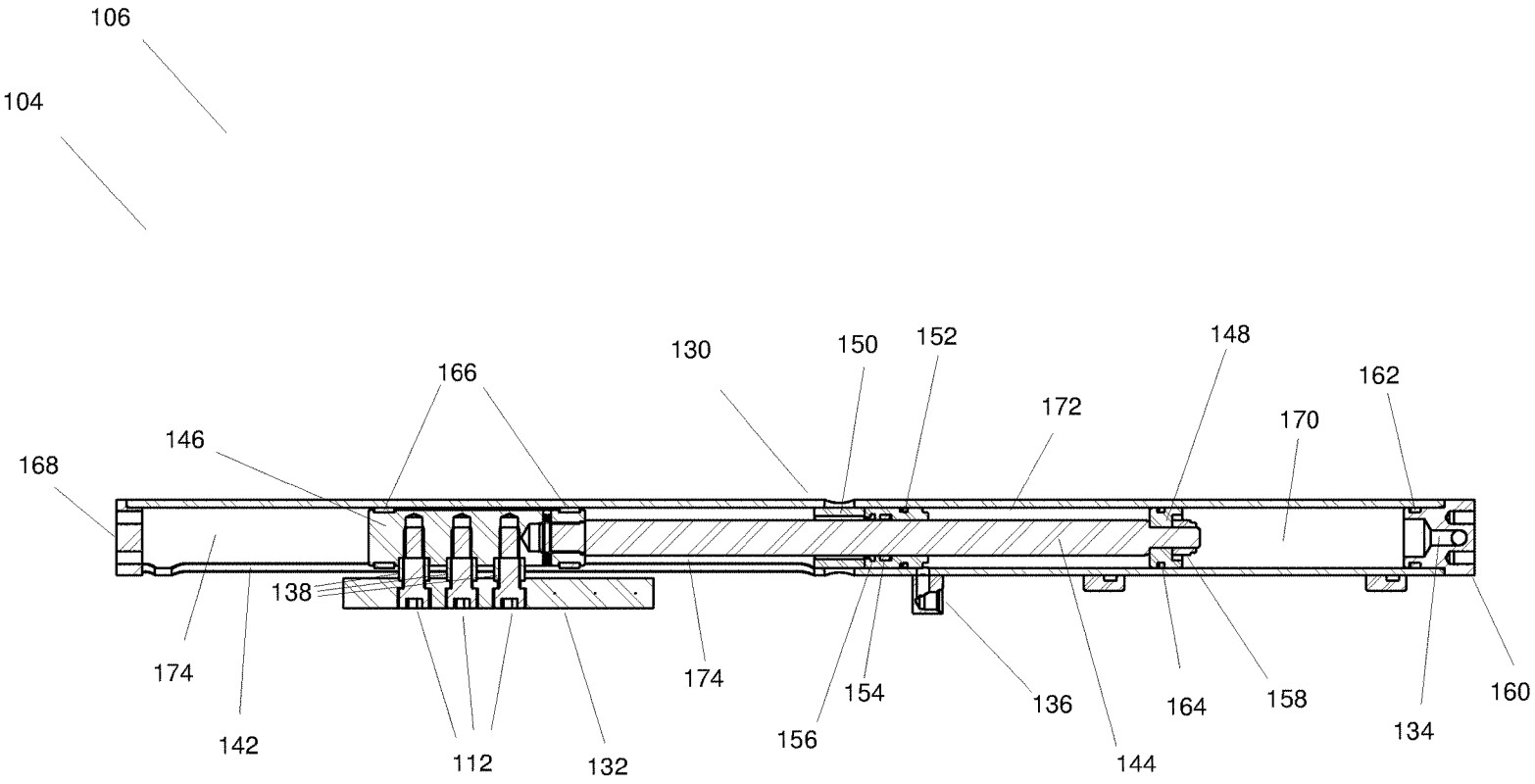
FIG. 5. Is a sectional side view of the inventive fork positioner from the representative embodiment of the fork positioner assembly shown in FIGS. 2-3.

FIGS. 4 and 5 show internal details of the first fork positioner 104. Internal details are the same for the second fork positioner 106 in the representative embodiment, but may vary in other embodiments. Inside an internal cavity of the actuator tube 130, the first fork positioner 104 has an actuator rod 144 with an actuator piston 148 coupled to one end and a carrier 146 coupled to the other end. In the representative embodiment, an end portion of the actuator rod 144 passes through the actuator piston 148 and is secured with a nut 158. The other end of the actuator rod 144 penetrates the carrier 146 and is secured by threading, welding or some other suitable method. The carrier 146 and actuator piston 148 are configured to be in sliding contact with the actuator tube 130. The actuator rod 144 passes through, and has sliding contact with, a septum 150 that is fixedly coupled to the actuator tube 130.

The internal cavity of the actuator tube 130 is divided into an outer pressure chamber 170, an inner pressure chamber 172 and a carrier cavity 174. The outer pressure chamber 170 is defined by the actuator tube 130, the actuator piston 148 and an actuator head 160 coupled to one end of the actuator tube 130. The inner pressure chamber 172 is defined by the actuator tube 130, the actuator piston 148, and the septum 150. The carrier cavity 174 is defined by actuator tube 130, the septum 150, and an actuator end cap 168 coupled to the other end of the actuator tube 130.

The actuator piston 148 is configured to hold pressurized hydraulic fluid in either the outer pressure chamber 170 or inner pressure chamber 172 regardless of whether the other is pressurized or not. In the representative embodiment, the actuator piston 148 has a piston o-ring 164 to seal and prevent flow of pressurized hydraulic fluid between the outer pressure chamber 170 and inner pressure chamber 172. Similarly, the septum 150 is configured to hold pressurized hydraulic fluid in the inner pressure chamber 172. In the representative embodiment, the septum 150 has a septum o-ring 152 to seal and prevent pressurized hydraulic fluid from flowing between the actuator tube 130 and septum 150 and thereby escaping the inner pressure chamber 172 to the carrier cavity 174. A rod seal 154 and a rod wiper 156 prevent pressurized hydraulic fluid from flowing between the septum 150 and the actuator rod 144.

The first fork positioner 104 has an outer pressure chamber fitting 134 near the actuator head 160 that is configured to port hydraulic fluid into or out of the outer pressure chamber 170. In the representative embodiment, the outer pressure chamber fitting 134 is located in the actuator head 160. The first fork positioner 104 has an inner pressure chamber fitting 136 near the septum 150 that is configured to port hydraulic fluid into or out of the inner pressure chamber 172.

The tube slot 142 is located in a portion of the actuator tube 130 that defines the carrier cavity 174. The carrier 146 is coupled to the fork holder 132 through the tube slot 142. In the representative embodiment, cap screws 112 removeably couple the carrier 146 to the fork holder 132. The cap screws 112 each pass through a slot bushing 138 configured to maintain an adequate distance between the fork holder 132 and the carrier 146, which will minimize wear between the fork holder 132 and the actuator tube 130. In the representative embodiment, the slot bushings 138 have sliding contact with the edge of the tube slot 142 and comprising bearing material to reduce friction and make them easy to replace wear components. Similarly, the carrier 146 has one or more carrier bushings 166. The carrier bushings 166 provide the sliding contact between the rest of the carrier 146 and the actuator tube 130. The carrier bushings 166 comprise bearing material, to reduce friction and make it an easy to replace wear component.

In operation, hydraulic fluid under pressure is ported to either the outer pressure chamber fitting 134 or inner pressure chamber fitting 136 to actuate the first fork positioner 104. If hydraulic fluid under pressure is ported to the outer pressure chamber fitting 134 and hydraulic fluid allowed to drain from the inner pressure chamber fitting 136, a force will be applied to the actuator piston 148 that will cause it to move away from the actuator head 160 and towards the septum 150, moving the actuator rod 144 in the same direction as well as the carrier 146 and the fork holder 132. If hydraulic fluid under pressure is ported to the inner pressure chamber fitting 136 and hydraulic fluid allowed to drain from the outer pressure chamber fitting 134, the actuator piston 148 will move toward the actuator head 160 and away from the septum 150, moving the actuator rod 144 in the same direction as well as the carrier 146 and the fork holder 132.

Force applied to the actuator piston 148 is transmitted through the actuator rod 144, the carrier 146 and fork holder 132 to a fork held therein. If there is significant resistance to the fork moving laterally, this applied force will cause the fork to deflect, which will in turn cause a moment to be applied back on the fork holder 132, which transmits the moment to the carrier 146. The carrier 146 transmits the moment primarily to the actuator tube 130 and not to the actuator rod 144. A large diameter tube can resist moment with less deflection and risk of damage than can a smaller diameter rod using a similar amount of material. Some structure is needed to guide the fork holder 132 and a fairly strong and robust tube is needed to serve as a hydraulic actuator. Extending the actuator tube 130 and using a portion of it to guide the fork holder 132 and receive moment from it synergistically uses a single component for all three purposes. As a result of the actuator tube 130 taking moment from the fork holder 132 and carrier 146, the actuator rod 144 can be made with a smaller diameter, using less material than if it had to carry the moment that the actuator tube 130 does.

Those skilled in the art will recognize that numerous modifications and changes may be made to the various embodiments without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the first embodiment is essential. Other embodiments are possible, their specific designs depending upon the particular application. As such, the scope of the invention should not be limited by the particular embodiments herein described but should be defined only by the appended claims and equivalents thereof.

What is claimed is:

1. A fork positioner comprising:

a tube with an interior cavity;

a septum positioned in the interior cavity, the septum coupled to the tube;

a rod passing through the septum, the rod in sliding contact with the septum;

a piston coupled to the rod, the piston located in the interior cavity in sliding contact with the tube;

a carrier coupled to the rod, the carrier located in the interior cavity on an opposite side of the septum from the piston, the carrier in sliding contact with the tube;

a slot in the tube on a same side of the septum as the carrier; and a fork holder positioned external to the tube, the fork holder coupled to the carrier through the slot in the tube.

2. The fork positioner of claim 1, further comprising:

the carrier with a first carrier bushing in sliding contact with the tube; and the carrier with a second carrier bushing in sliding contact with the tube.

3. The fork positioner of claim 2, wherein the first carrier bushing is near a first end of the carrier near the rod and the second carrier bushing is near a second end of the carrier opposite the first end.

4. The fork positioner of claim 2, wherein the carrier has a coupled portion that is coupled to the fork holder; and wherein the coupled portion of the carrier is between the first carrier bushing and the second carrier bushing.

5. The fork positioner of claim 4, wherein the fork holder is coupled to the carrier by a plurality of cap screws passing through the fork holder, through the slot in the tube, and into the coupled portion of the carrier.

6. A fork positioning assembly comprising:

a fork frame with a top bar, a bottom bar, a left side bar, and a right side bar;

a first fork positioner coupled to the left side bar and right side bar, the first fork positioner comprising a first tube with a first interior cavity, a first carrier positioned in the first interior cavity in sliding contact with the first tube, and a first fork holder external to the first tube, the first fork holder coupled to the first carrier through a first slot in the first tube;

a second fork positioner coupled to the left side bar and right side bar, the second fork positioner comprising a second tube with a second interior cavity, a second carrier in the second interior cavity slidingly contacting the second tube, and a second fork holder external to the second tube, the second fork holder coupled to the second carrier through a second slot in the second tube;

wherein the first fork positioner and the second fork positioner are vertically arranged with one above the other;

wherein the slot in the tube of the first fork positioner faces the bottom bar; and wherein the slot in the tube of the second fork positioner faces the bottom bar.

7. The fork positioning assembly of claim 6, wherein the first fork positioner and the second fork positioner are substantially identical.

8. The fork positioning assembly of claim 6, wherein the first fork positioner is a mirror image of the second fork positioner relative to a vertical plane intersecting and perpendicular to the top bar and the bottom bar of the fork frame.

9. A fork positioning assembly comprising:

a fork frame with a top bar, a bottom bar, a left side bar, and a right side bar;

a first fork positioner coupled to the left side bar and right side bar;

a second fork positioner coupled to the left side bar and right side bar; and wherein the first fork positioner and the second fork positioner each comprise:

a tube with an interior cavity, a rod positioned within the interior cavity, a piston coupled to the rod, the piston positioned in the interior cavity in sliding contact with the tube, a carrier coupled to the rod, the carrier positioned in the interior cavity in sliding contact with the tube, a slot in the tube, a fork holder positioned external to the tube, the fork holder coupled to the carrier through the slot in the tube, wherein the slot in the tube of the first fork positioner faces the bottom bar, and wherein the slot in the tube of the second fork positioner faces the bottom bar.

10. The fork positioning assembly of claim 9, wherein the first fork positioner and the second fork positioner are arranged one above the other.

11. The fork positioning assembly of claim 9, wherein the first fork positioner and the second fork positioner are arranged with the slot of one closer to the left side bar and the slot the other closer to the right side bar.

12. The fork positioning assembly of claim 9, wherein the second fork positioner is a substantially identical copy of the first fork positioner that is rotated 180 degrees around a vertical axis.

13. A fork positioning assembly comprising:

a fork frame with a top bar, a bottom bar, a left side bar, and a right side bar;

a first fork positioner coupled to the left side bar and right side bar;

a second fork positioner coupled to the left side bar and right side bar;

wherein the first fork positioner and the second fork positioner each comprise:

a tube with an interior cavity, a rod positioned within the interior cavity, a piston coupled to the rod, the piston positioned in the interior cavity in sliding contact with the tube, a carrier coupled to the rod, the carrier positioned in the interior cavity in sliding contact with the tube, a slot in the tube, a fork holder positioned external to the tube, the fork holder coupled to the carrier through the slot in the tube;

a septum positioned in the interior cavity, the septum coupled to the tube; and wherein the slot in the tube is on a same side of the septum as the carrier.

14. The fork positioning assembly of claim 13, further comprising:

the carrier with a first carrier bushing in sliding contact with the tube; and the carrier with a second carrier bushing in sliding contact with the tube.

15. The fork positioning assembly of claim 14, wherein the first carrier bushing is near a first end of the carrier near the rod and the second carrier bushing is near a second end of the carrier opposite the first end.

16. The fork positioning assembly of claim 14, wherein the carrier has a coupled portion that is coupled to the fork holder; and wherein the coupled portion of the carrier is between the first carrier bushing and the second carrier bushing.

17. The fork positioning assembly of claim 16, wherein the fork holder is coupled to the carrier by a plurality of cap screws passing through the fork holder, through the slot in the tube, and into the coupled portion of the carrier.

* * * * *